US007823852B1

(12) United States Patent
Reno

(10) Patent No.: US 7,823,852 B1
(45) Date of Patent: Nov. 2, 2010

(54) BALUSTER SUPPORT BRACKET

(76) Inventor: Terrence A. Reno, 40 Wendover Rd., Asheville, NC (US) 28806

( * ) Notice: Subject to any disclaimer, the term of this patent is extended or adjusted under 35 U.S.C. 154(b) by 0 days.

(21) Appl. No.: 12/269,976

(22) Filed: Nov. 13, 2008

(51) Int. Cl.
*A47H 1/16* (2006.01)

(52) U.S. Cl. ..... 248/302; 248/218.4

(58) Field of Classification Search ..... 248/27.8, 248/218.4, 235, 246, 249; 211/85.31, 112; 47/39, 40
See application file for complete search history.

(56) References Cited

U.S. PATENT DOCUMENTS

| | | | | |
|---|---|---|---|---|
| 141,498 | A | | 8/1873 | Edmonston |
| 280,639 | A | | 7/1883 | Lipe |
| 783,837 | A | | 2/1905 | Johnston |
| 950,043 | A | | 2/1910 | Gierding |
| 986,409 | A | | 3/1911 | Scotellaro |
| 1,206,574 | A | | 11/1916 | Miller |
| 1,236,254 | A | | 8/1917 | Bloomberg |
| 1,240,377 | A | | 9/1917 | Seng |
| 1,455,312 | A | | 5/1923 | Turner |
| 1,545,740 | A | | 7/1925 | Cowell |
| 1,674,960 | A | | 6/1928 | Deane |
| 1,728,613 | A | | 9/1929 | Jones |
| 2,485,288 | A | | 10/1949 | Homann |
| 2,605,074 | A | * | 7/1952 | Bucsko et al. ..... 248/235 |
| 2,774,562 | A | | 12/1956 | Henry |
| 2,854,293 | A | | 9/1958 | Riblet |
| 3,018,898 | A | | 1/1962 | Frazelle |
| 3,064,933 | A | | 11/1962 | Brasty |
| 3,127,144 | A | | 3/1964 | Warner |
| 3,153,526 | A | | 10/1964 | Pawsey |
| 3,272,467 | A | | 9/1966 | Kassube |
| D251,579 | S | * | 4/1979 | Calgaro ..... D6/566 |
| 4,415,137 | A | * | 11/1983 | Garves ..... 248/629 |
| 4,427,092 | A | | 1/1984 | Tentler |
| 4,428,459 | A | | 1/1984 | Peck |
| 4,666,115 | A | * | 5/1987 | Schiro ..... 248/225.11 |
| 4,908,982 | A | | 3/1990 | Quatrini |
| 5,292,014 | A | * | 3/1994 | Lelong ..... 211/85.23 |
| 5,395,081 | A | | 3/1995 | Vollink |

(Continued)

OTHER PUBLICATIONS

DC Products LLC, Planter Box Brackets, webpage, 2003, two pages, www.dcproductsllc.com, U.S.
Automated Metal Technologies, Steel Flower Pot Holders, 2007, webpage, two pages, www.flowerpotholders.com, U.S.

*Primary Examiner*—Amy J Sterling

(57) ABSTRACT

A bracket adapted to be used in sets for supporting planter boxes, benches, and similar elongated items from multiple vertical supports such as the balusters on a deck railing. The bracket mounts securely and strongly on the baluster without requiring fasteners, and is easily adjusted up and down and removed as necessary. The bracket can be formed from a single piece of stock, for example using a metal rod formed into shape. The bracket has a generally triangular shape with an upper support arm terminating in a squared open hook that mounts from behind to engage the sides of the baluster, a lower angled support arm extending down and in from the upper arm toward the baluster, and a baluster-abutting foot portion that engages the face of the baluster when the upper arm is horizontal. An adapter can be used on the open end of the hook to ensure a tight fit with undersized balusters.

5 Claims, 3 Drawing Sheets

U.S. PATENT DOCUMENTS 5,535,974 A * 7/1996 Savitski ..... 248/246
5,934,014 A * 8/1999 Carrothers ..... 47/39
6,209,837 B1 4/2001 Harms
6,375,141 B1 * 4/2002 Kettlestrings ..... 248/303
6,971,204 B1 * 12/2005 Gibney ..... 47/39
7,275,728 B1 10/2007 Branson

* cited by examiner

BALUSTER SUPPORT BRACKET

FIELD OF THE INVENTION

The invention is in the field of pot and planter support brackets that can be secured to the vertical posts or "balusters" in a deck railing.

BACKGROUND OF THE INVENTION AND DESCRIPTION OF RELATED ART

Gardeners commonly hang flowerpots and planter boxes from the wooden railings on their porches or decks. Common methods include securing hooks or brackets with nails or screws to the horizontal railings, or to the vertical posts or "balusters" that support the railings. This mars the balusters and railings, however, and is often undesirable or prohibited.

Brackets that hook or slide onto balusters or similar vertical posts are known, but suffer from several shortcomings. A common type represented in the prior art is a cantilever-arm design in which an angled hook or loop at the base of the horizontal arm frictionally engages the baluster, for example as shown in U.S. Pat. Nos. 4,908,982 to Quatrini; 6,971,204 to Gibney; and 3,272,467 to Kassube. This design is relatively weak, usually shown holding a single flowerpot (or bucket in the case of Kassube). Moreover, these brackets must typically be applied from the side of the baluster, making them suitable only for relatively widely spaced balusters or for the endmost balusters on the railing.

Another problem with many prior art brackets is their limited ability to be used effectively in pairs, either serially to support long planter boxes, or in opposing fashion extending from the front and rear faces of a single baluster.

BRIEF SUMMARY OF THE INVENTION

According to the invention, a bracket for a squared baluster or similar vertical post or support (hereafter "baluster") comprises an upper horizontal support arm with a flared, square hook on its inner end, the hook opening forward toward the horizontal arm so that it can be applied to the rear face of the baluster, frictionally engaging the side faces of the baluster; and an angled lower arm extending from an outer end of the horizontal arm back down toward a lower front face of the baluster, where it ends in a "foot" that abuts the front face of the baluster when the upper arm is horizontal. The bracket thus has a generally triangular shape with the baluster forming the "base" of the triangle.

In a further form, the upper and lower arms of the bracket are connected by an internal brace that forms a triangular "loop" at the outer end of the bracket. This strengthens the bracket and creates a place to hook or hang items from the lower side of the bracket.

Another feature of the invention is an adapter sleeve that can be added or removed as needed to the end of the rear hook, so that the hook makes a tight fit with balusters narrower than the hook.

The resulting bracket is non-marring, extremely strong, is easily formed from a single piece of wire or rod, can be applied to closely-spaced inner balusters in a railing, can be used in front-to-back pairs on a single baluster with very little difference in height, and adapts readily to balusters of different thickness. The bracket also provides an elegant and uniquely ornamental appearance.

These and other features and advantages of the invention will become apparent from the detailed description below, in light of the accompanying drawings.

DETAILED DESCRIPTION OF THE INVENTION

Figure 1:
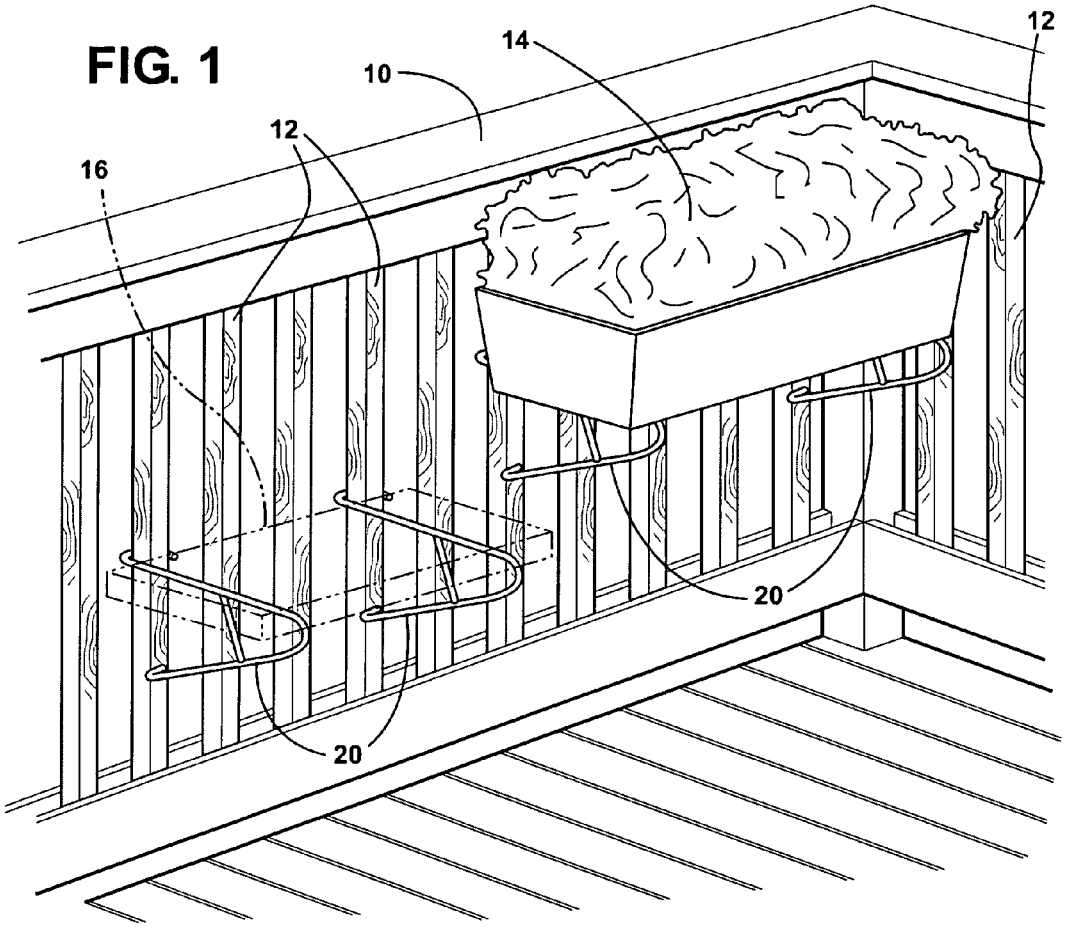
FIG. 1 is a perspective view of two sets of brackets according to the invention, one set supporting a planter box, one set supporting a bench/shelf.

Referring first to FIG. 1, a deck railing comprising a horizontal top rail 10 supported by a plurality of vertical balusters 12 is supplied with two sets of brackets 20 according to the invention. Brackets 20 are essentially identical to one another, and are preferably used in sets of two or more to support elongated items such as the illustrated planter box 14 and shelf/bench 16. Brackets 20 can also be used individually to hang items such as flowerpots, tools, lanterns, and decorations.

It will be understood that while brackets 20 are shown being used to support items from the balusters of a typical deck railing, the brackets can also be used on other types of vertical post or support having a cross-sectional shape with squared or angled sides with little or no modification. In the illustrated embodiment, the balusters are square (rectangular) in cross-section, and the "hook" portion of the bracket 20 has a correspondingly squared (rectangular) shape which readily fits (or can be readily adapted to) other multi-sided shapes such as hexagonal or octagonal, as shown in FIG. 6A.

Figure 2:
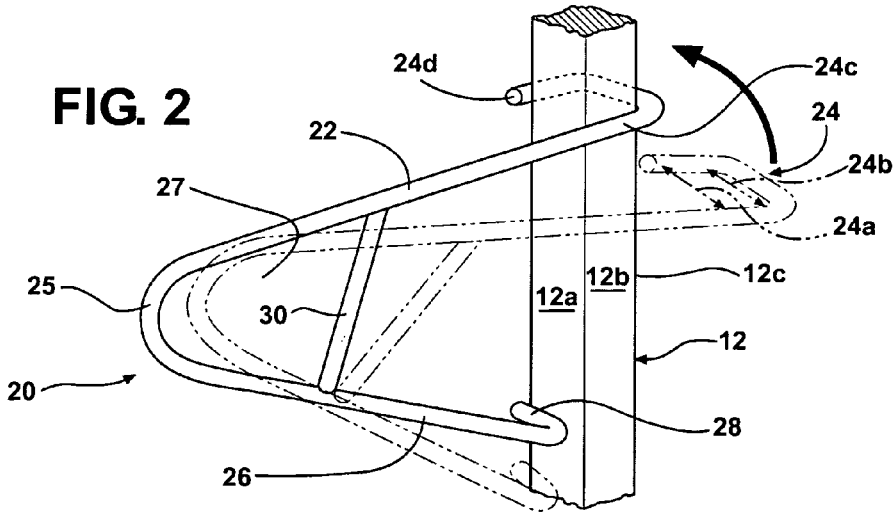
FIG. 2 is a perspective view of one of the brackets of FIG. 1, showing the manner in which the bracket is installed and removed from a baluster.

Referring to FIG. 2, each bracket 20 comprises a horizontal support arm 22 terminating at its inner baluster-engaging end in an open hook 24. Hook 24 opens forwardly, i.e. toward horizontal support arm 22, so that the hook is engaged with the baluster from the side opposite that from which horizontal support arm 22 extends. Bracket 20 also includes an angled lower arm 26, extending downwardly and rearwardly toward a point on baluster 12 spaced below hook 24. Angled lower arm 26 terminates in a foot 28 that abuts the front face 12*a* of baluster 12 when bracket 20 is installed on the baluster. In the illustrated embodiment, horizontal support arm 20 and hook 24 and angled lower arm 26 and foot 28 are formed from a single piece of strong, rigid metal rod or wire, for example similar to steel re-bar in thickness and strength, bent or otherwise formed into the illustrated shape. It will be apparent to those skilled in the art that bracket 20 could also be made from multiple pieces, and from different materials, and in different thicknesses and cross-sections, although the illustrated single-piece rod construction is preferred.

It is also preferred (but not required) that horizontal support arm 22 and angled lower arm 26 be additionally strengthened with a bracing member 30 extending between them at some distance from the outer or distal end 25 of the bracket. Bracing member 30 is preferably substantially vertical, and prevents angled lower arm 26 from flexing away from horizontal support arm 22 under heavy loads. Bracing member 30 also creates a triangular "loop" 27 between outer end 25 and the bracing member from which various objects and implements can be hung without sliding down lower arm 26.

While it is possible to form bracing member 30 as an integral piece of the material used for bracket 20, for example where bracket 20 is molded from plastic or cast from metal as a single piece, in the rod-formed example of FIG. 1 it will be more typical to weld or otherwise secure bracing member 30 between arms 22 and 26 after the rod has been formed into shape.

Hook portion 24 at the rear or inner end of horizontal support arm 22 is applied to baluster 12 to frictionally engage and grip the baluster at sides 12*b* and at rear face 12*c*. While hook 24 is substantially rectangular to approximate the cross-section of baluster 12, it is a slightly flared rectangular shape, with the opening 24*a* of the hook (its apex) made slightly wider than its closed end or base 24*b* (its vertex), for example by angling free end 24*d* outwardly away from opposite side 24*c* during the manufacturing process. Opening 24*a* is equal to the width of baluster 12 and base 24*b* is slightly less than the width of baluster 12, creating a wedge fit with the baluster tight enough to hold bracket 20 in place under its own weight until an external load is placed on the bracket.

Referring to FIG. 2, bracket 20 is attached to baluster 12 by placing hooked end 24 behind the baluster with horizontal support arm 22 angled above horizontal, and pulling the bracket forward until it contacts the rear face 12*c* of the baluster. Bracket 20 is then rotated down until foot 28 engages the front face 12*a* of the baluster. Removing bracket 20 is done in reverse, i.e. horizontal support arm 22 is rotated up to lift foot 28 off baluster face 12*a*, and hook 24 is then pushed back off baluster 12. While foot 28 is shown in the illustrated example as a preferred perpendicular bend in the rod of the lower support arm 26, running parallel to the face of baluster 12 for a non-marring abutment, other shapes and forms are possible for foot 28.

Figure 4:
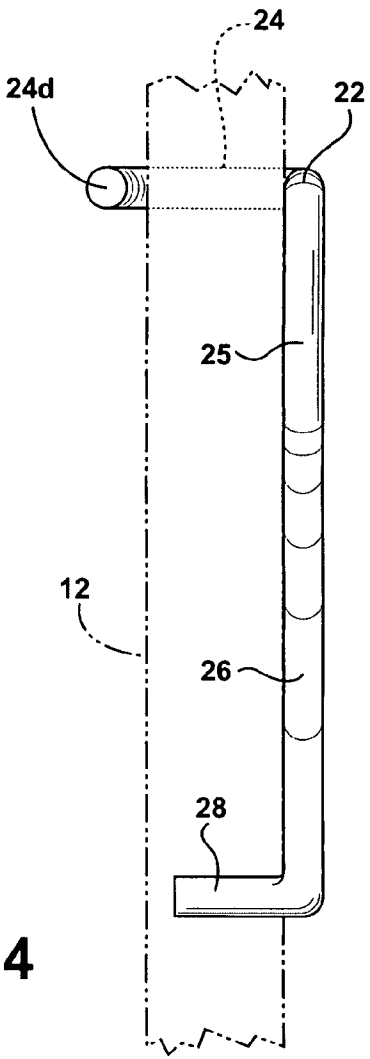
FIG. 4 is a front elevation view of the bracket of FIG. 2 mounted on a baluster.
Figure 3:
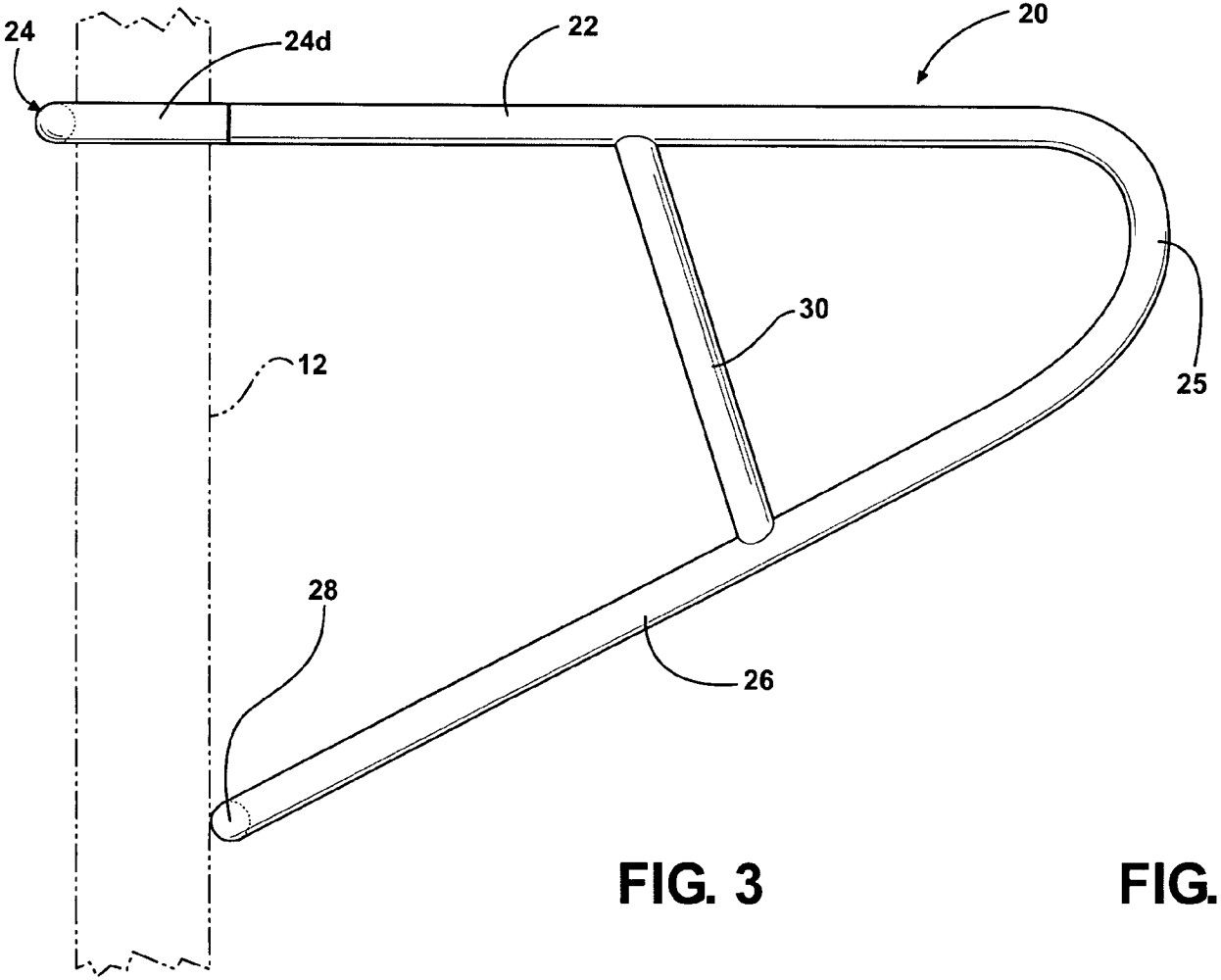
FIG. 3 is a side elevation view of the bracket of FIG. 2 mounted on a baluster.

FIGS. 3 and 4 are side and rear elevation views of the bracket 20 as mounted on baluster 12 in FIG. 1. While hook portion 24 and foot 28 are aligned with the baluster, the vertical plane of horizontal support arm 22 and angled lower arm 26 is offset to one side of the baluster a distance corresponding to the thickness of the rod from which they are formed. Since the thickness of arms 22 and 26 will generally be less than the width of baluster 12, especially when strong materials such as steel or reinforced plastics are used, and since the overall width of hook portion 24 must fit between adjacent balusters, bracket 20 fits nicely between even closely spaced balusters.

Figure 5:
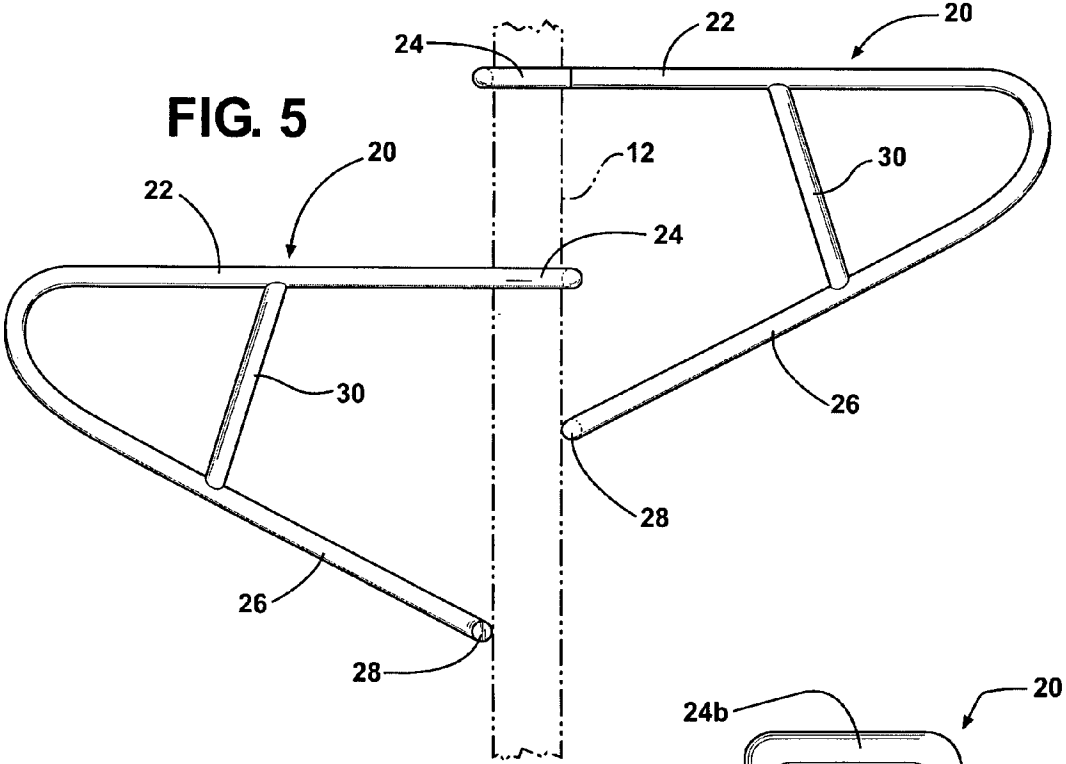
FIG. 5 is similar to FIG. 3, but shows an additional bracket extending from the opposite side of the same baluster.

The substantially thin, planar shape of bracket 20, even when formed from round rod as illustrated, allows multiple brackets 20 to be used on a single baluster in opposing fashion, at essentially the same height. Referring to FIG. 5, a second bracket 20 has been mounted on baluster 12 slightly below and facing the opposite direction from bracket 20. Bracket 20 is identical to bracket 20 so that the planes of the support arm portions 22, 26 of the brackets will be on opposite side faces 12*b* of baluster 12. It is also possible to use brackets 20 whose hook portions 24 and feet 28 extend from opposite sides of the planes of their arms 22 and 26, so that the arms 22 and 26 of both brackets are located adjacent the same side face 12*b* of the baluster when mounted as in FIG. 5.

It will be understood by those skilled in the art that while an offset support-arm plane is illustrated, it would also be possible to additionally bend or form horizontal support arm 22 and/or angled lower arm 26 to place one or both in the same plane as baluster 12, rather than being offset to one side.

Figure 6:
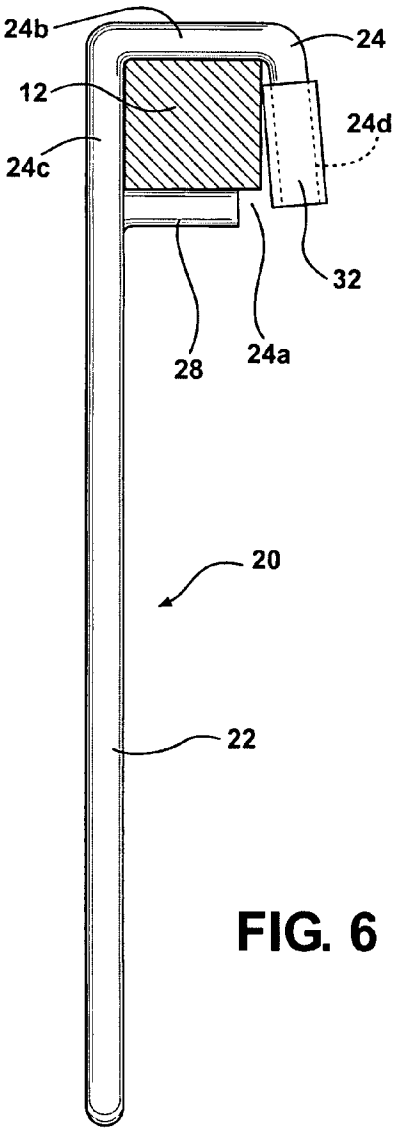
FIG. 6 is a top plan view of the bracket of FIG. 2, with the baluster in section, and illustrating an adapter for fitting the bracket to a narrower baluster.
Figure 6A:
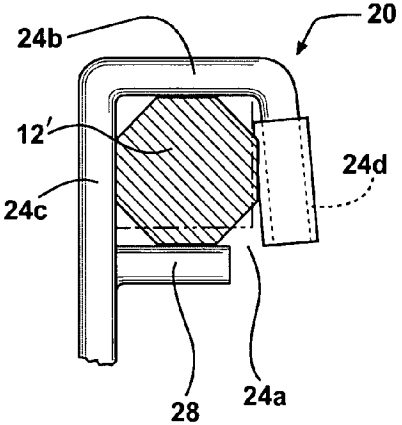
FIG. 6A is similar to FIG. 6, but shows the bracket fitted to a differently shaped baluster.

Referring now to FIG. 6, bracket 20 is shown in plan view relative to a baluster 12 that is narrower than would be ideal for a good fit with hook 24. The free end 24*d* of hook 24 is accordingly provided with a tubular adapter 32 that slides onto the free end to provide a tight wedge fit with the baluster. The illustrated adapter 32 is made from a dense, resilient plastic or rubber material, although other materials could be used.

Although the illustrated brackets are shown being used in pairs, it will be understood that three or more brackets 20 could be used in series to support heavier or longer objects than those shown.

When used to support benches, planter boxes, and the like on the deck-side of a railing or balustrade, brackets 20 are easily adjusted up and down without tools, and leave the area underneath virtually unobstructed to provide clearance for chairs, walkers, and wheelchairs.

It will finally be understood that the disclosed embodiments are representative of presently preferred forms of the invention, but are intended to be explanatory rather than limiting of the invention. Reasonable variation and modification of the invention as disclosed in the foregoing disclosure and drawings are possible without departing from the scope of the invention. The scope of the invention is defined by the following claims.

The invention claimed is:

1. A bracket adapted to be removably mounted on a vertical support such as a baluster, having a cross-section with a front face and a rear face and substantially flat sides, the bracket consisting of:

an upper support arm terminating at an inner end in a substantially horizontal planar hook portion offset to a first substantially horizontal side of the upper support arm, the hook portion having a forwardly-facing opening facing in a direction substantially parallel to the upper support arm and adapted to frictionally engage the substantially flat sides of a vertical support from a rear face of a vertical support;

a lower support arm extending downwardly and rearwardly from an outer part of the upper support arm at an acute angle, the upper and lower support arms defining a substantially vertical plane substantially perpendicular to the plane of the hook portion, the lower support arm terminating in a foot extending to the first substantially horizontal side from the lower support arm in a plane substantially perpendicular to the substantially vertical plane of the upper and lower support arms such that the foot and the hook portion's forwardly-facing opening are aligned to the first substantially horizontal side of the substantially vertical plane defined by the upper and lower support arms with the foot spaced forwardly of and below the hook portion, the foot adapted to abut a front face of a vertical support if the hook portion is placed over a rear face of a vertical support such that the upper support arm extends is substantially horizontal wherein the width of the opening of the hook portion is adapted to be substantially equal to a width of a vertical support between its substantially flat sides, and the width of the base of the hook portion is adapted to be less than a width of a vertical support between the its substantially flat sides.

2. A bracket according to claim 1, wherein the hook portion is polygonal and the opening of the hook portion has a width greater than a base of the hook portion.

3. A bracket according to claim 1, further including an adapter tube removably secured to the open end of the hook portion and adapted to engage a substantially flat side of a vertical support.

4. A bracket according to claim 1, wherein a substantially vertical brace member is connected between the upper support arm and the lower angled support arm between a distal end of the bracket and both the hook portion and the foot.

5. A bracket according to claim 1, wherein the upper and lower support arms further define a substantially triangular plane between them.

* * * * *